US006192556B1

(12) United States Patent
Kikko et al.

(10) Patent No.: US 6,192,556 B1
(45) Date of Patent: Feb. 27, 2001

(54) FEMALE COMPONENT FOR TOUCH AND CLOSE FASTENER AND METHOD OF MANUFACTURING THE SAME

(75) Inventors: Keiko Kikko; Hideo Kimura, both of Sowa (JP)

(73) Assignee: Japan Vilene Company, Ltd., Tokyo (JP)

( * ) Notice: Subject to any disclaimer, the term of this patent is extended or adjusted under 35 U.S.C. 154(b) by 0 days.

(21) Appl. No.: 09/251,344

(22) Filed: Feb. 17, 1999

(30) Foreign Application Priority Data

Feb. 23, 1998 (JP) ..... 10-058872
Dec. 28, 1998 (JP) ..... 10-376997

(51) Int. Cl.[7] ..... A44B 18/00; B32B 3/00
(52) U.S. Cl. ..... 24/445; 24/304; 24/450; 24/451
(58) Field of Search ..... 24/445, 447, 450, 24/451, 452, 304

(56) References Cited

U.S. PATENT DOCUMENTS 3,694,867 * 10/1972 Stumpf ..... 24/304
4,379,189 4/1983 Platt .
4,537,819 * 8/1985 Schortmann et al. ..... 428/284
5,114,787 * 5/1992 Chaplin et al. ..... 428/284
5,254,399 * 10/1993 Oku et al. ..... 428/288
5,326,612 * 7/1994 Goulait ..... 428/100
5,516,572 * 5/1996 Roe ..... 428/131
5,624,427 * 4/1997 Bergman et al. ..... 604/391
5,624,729 * 4/1997 Cohen et al. ..... 428/90
5,714,107 * 2/1998 Levy et al. ..... 264/289.3
5,786,060 7/1998 Takahashi et al. .
5,858,515 * 1/1999 Stokes et al. ..... 428/195
5,891,547 * 4/1999 Lawless ..... 428/92
5,942,451 * 8/1999 Daponte et al. ..... 442/329

FOREIGN PATENT DOCUMENTS 0 171 807 A3 8/1985 (EP) .

OTHER PUBLICATIONS

Japanese Industrial Standard, "Touch and Close Fastener", JIS L 1994.
Japanese Industrial Standard, "Touch and Close Fastener", JIS L 1988.

* cited by examiner

*Primary Examiner*—Victor N. Sakran
(74) *Attorney, Agent, or Firm*—Oliff & Berridge, PLC

(57) ABSTRACT

A simple and less expensive nonwoven female component for a mechanical refastenable fastening device ("touch and close fastener") can be conveniently used in mostly disposable applications such as disposable diapers, disposable operating gowns, disposable underwear and other clothing. The nonwoven fabric female component includes projecting loops formed on one of the superficial sides of the nonwoven fabric. The nonwoven fabric comprises a hydroentangled web, and the loops are projectingly formed by needle punching on or at one of the superficial sides of the hydroentangled web.

5 Claims, 1 Drawing Sheet

FEMALE COMPONENT FOR TOUCH AND CLOSE FASTENER AND METHOD OF MANUFACTURING THE SAME

BACKGROUND OF THE INVENTION

1. Field of Invention

The present invention relates to a simple and less expensive female component for a mechanical refastenable fastening device (i.e., "touch and close fastener" or "hook and loop-type fastener") which is conveniently used in mostly disposable applications such as disposable diapers, disposable operating gowns, disposable underwear and other clothing.

2. Description of Related Art

Hook and loop-type fasteners have been constituted of two components, a female component having loop-shaped female elements placed on the surface of cloth such as knitted or woven fabric and a male component having hook-shaped or mushroom-shaped male elements capable of engaging with the female element, the male elements being placed on the surface of another cloth. When the female component and the male component are pressed together in a face-to-face relationship to close the fastener, the two elements placed on both clothes engage each other to form a plurality of mechanical bonds therebetween. This engagement is utilized not only for clothing but also for various daily necessaries such as bags. Conventional female elements which have been widely known are female components wherein multi-filaments or mono-filaments made of synthetic resins such as nylon and polyester are utilized and loops made up of such filaments are formed on a cloth for their support.

In the case of a female component constituted from the above-mentioned knitted or woven fabric as a support, a strong structure can be adopted and, therefore, a big engaging force between the female component and the male component can be achieved. On the other hand, however, due to the use of knitted or woven fabric, the cost is high in the above female component which is produced via complicated manufacturing steps. Accordingly, it is difficult to utilize the simple and easy engaging function of the touch and close fastener (hook and loop-type fastener) in such a use where products (such as a disposable diaper) are disposed after about five to ten engagements and a relatively small magnitude of the engaging force acting therebetween is enough for actual use.

There have been various proposals for female components utilizing nonwoven fabric which is relatively in low cost due to its high productivity instead of such knitted or woven fabric. As mentioned already, the nonwoven fabric female component is inferior in terms of absolute engaging capability to the female component made up of knitted or woven fabric. In applying to the use where relatively small engaging ability will do, however, the advantage of the use of nonwoven fabric is not only that it has a high productivity but also that a constituent in a sheet form and a female element constituting the loop can be utilized substantially in one constituent component whereby it is possible to offer a very less expensive female component. It is also expected that, unlike the knitted or woven fabric, the nonwoven fabric female component would have a good characteristic that fraying upon cutting hardly takes place.

However, in known female components made of nonwoven fabric, there is a disadvantage that a reduction in an engaging capability is high, as compared with those made of knitted or woven fabric, after repeated engagements to the extent of 5 to 10 times in view of disposable applications.

The present inventors paid their attention to this point, have conducted an intensive study for keeping the above engaging capability of a touch and close fastener (hook and loop-type fastener) made of nonwoven fabric, even having excellent advantages, and have succeeded in producing the present invention.

Accordingly, an object of the present invention is to provide an art capable of preventing a female component from the reduction of its inceptive engaging force (engaging force at an initial use) after repeated engagements and to achieve and provide an improved low-cost female component for a touch and close fastener (hook and loop-type fastener) with highly advantageous characteristics.

SUMMARY OF THE INVENTION

The present invention firstly provides a nonwoven fabric female component for a touch and close fastener (i.e., hook and loop-type fastener) in which projecting loops are formed on one of the superficial sides of the nonwoven fabric, said female component wherein (i) said nonwoven fabric comprises a hydroentangled web, and (ii) said loops are projectingly formed by needle punching on or at one of the superficial sides of said hydroentangled web.

The present invention secondly provides a method for the manufacture of a nonwoven fabric female component for a touch and close fastener in which loops are projectingly formed on one of the superficial sides of the nonwoven fabric, said method comprising the steps of:

(i) forming a hydroentangled web, and (ii) needle punching said hydroentangled web to form the loops.

DETAILED DESCRIPTION OF PREFERRED EMBODIMENTS

Figure 1:
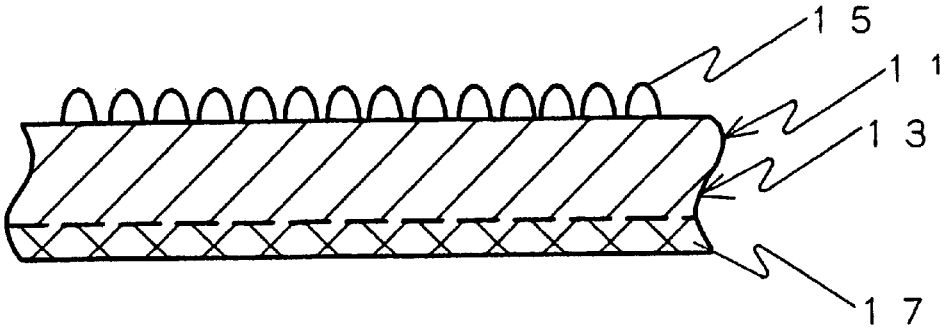
FIG. 1 is a simplified schematic side view of an embodiment of the nonwoven fabric female component of the present invention.

Described below is a mode of carrying out the present invention by showing several suitable embodiments and by referring to the drawings. In the technique for manufacturing nonwoven fabrics, needle punching techniques and hydroentangling techniques by means of high pressure jets of water have been well known as the art for entangling a fiber web. The present inventors have applied a hydroentangling technique to a fiber web to form a hydroentangled web and then have also applied a needle punching technique to the resultant hydroentangled web to form loops. As a result, the present inventors have found that a female component for a touch and close fastener can be made up of said treated nonwoven fabric and has advantageous and improved characteristics with less reduction in an engaging capability even after repeated engagements.

First, an embodiment of the female component according to the present invention will be illustrated hereinbelow by referring to FIG. 1 in which a simplified schematic side view thereof is shown. The female component (11) of the present invention is prepared by techniques which will be mentioned later in detail. The female component (11) is equipped with loops (15) projected from a hydroentangled web (13) which is obtained by applying the above-mentioned hydroentangling. In a preferred embodiment of the present invention, a flat and smooth region (17) constituted by heat fusing fiber constituents can be formed on the surface of the hydroentangled web (13), the surface being different from the surface on which loops (15) are formed. The flat and smooth region is set up there for reducing fluffs which are produced via drawing out the loops from the fiber web upon detachment by a male element (not shown in the drawings) during repeated engagements. Such a reduction of the fluffs is not an effect which has resulted exclusively from setting up the flat and smooth region, but, preferably, it can also be expected when a fiber web is made up of heat-fusible fibers in an amount of not less than 50 mass %. Especially not only for holding the loops firmly but also for inhibiting the reduction in engaging force due to the above fluffing upon engagement with and peeling from the male component, it is also effective that the fiber web is composed of the heat-fusible fibers exclusively. The heat-fusible fiber used herein includes conventionally known composite fibers wherein two or more resins each having a different melting point are oriented in a form such as side-by-side or core-and-sheath.

The fiber web used in the present invention may include not only a product obtained by carding short fibers, but also a spun bond nonwoven fabric made up of long fibers. At that time, a part of the fibers constituting the hydroentangled web (13) is treated with a needle punching technique to form loops (15) projectingly, the loops (15) being constituting elements directly related to an engagement with the male elements. Therefore, in order to achieve an entangling force sufficient for actual use, it is preferred that the hydroentangled web (13) is made up of fibers where the strength of the single filament is not less than 2 g/denier. In addition, it is preferred that the size of such a fiber is from 0.5 denier to 10 deniers. If a finer fiber than above is used, the loops are crestfallen due to a low rigidity of the fiber, whereby in some cases its engagement with the male component may be deteriorated and it may be difficult to achieve a sufficient engaging force.

It has been known that, when short fibers are carded to form a fiber web, the carded fiber is usually oriented unidirectionally along the production direction of the web (the web having such an orientation is called a "unidirectional web"). Such a unidirectional web is formed in a certain surface density depending upon the ability of a carding machine and, therefore, when one sheet of the unidirectional web lacks, for example, a desired surface density, the following two means can ensure its surface density:

(1) lamination is conducted so that plural unidirectional webs show the same orientation, and (2) the resulting unidirectional web is laminated and oriented by folding from one end of the width direction of a running endless belt to another end thereof.

There are three forms regarding the fiber web obtained by those two laminating means, i.e., (i) a unidirectional web which is formed only by the former means, (ii) a cross-lay web which is formed only by the latter means, and (iii) a crisscross web, formed by a combination of both the means, in which the state of fiber orientation within a web surface is in a shape of an asterisk(*).

According to experiments conducted by the present inventors, it is preferred that a suitable female component for a touch and close fastener is selected from the above-mentioned two species, i.e., the cross-lay web and the crisscross web. To be more specific, it is desirable that the weight ratio W (%) of a cross-lay web is from 30% to 100%, or more preferably from 60% to 100%, for the surface density of a fiber web used as a female component for a touch and close fastener. For such a ratio in weight, the value in the fiber web prior to hydroentangling is substantially equal to that in the finally obtained female component for a touch and close fastener. Although a detailed mechanism is not clear for an improvement in engaging force reduction by a product containing a cross-lay web in such a suitable range, it is likely that, when needle punching is applied to the fiber web transferred in a predetermined direction in order to form loops, the fiber orientation, crossing the transferring direction as in the case of the cross-lay web, is highly resistant to punching needles and serves advantageously to form stronger loops. Further, when a female component for a touch and close fastener is constituted by a combination of the above-mentioned short fiber web with a long fiber web represented by a spun-bond nonwoven fabric, the change in the position of the long fiber is relatively small upon application of needle punching and, therefore, such a long fiber web shows the same behavior as the unidirectional web does.

Figure 2:
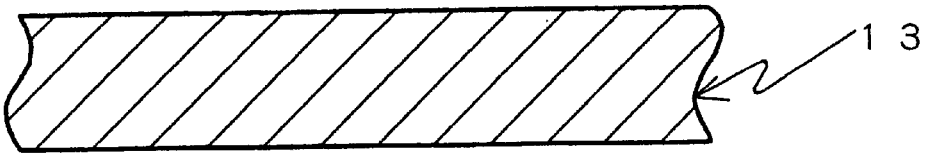
FIG. 2 is a simplified schematic side view of an embodiment of the nonwoven fabric female component wherein one of the steps in the manufacturing method according to the present invention is applied.
Figure 3:
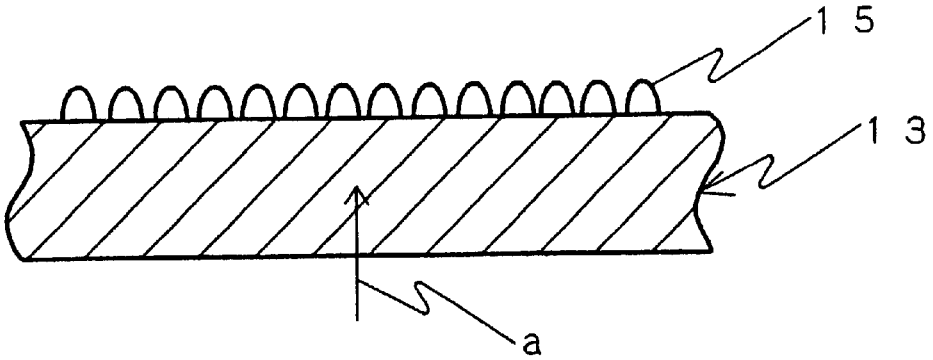
FIG. 3 is a simplified schematic side view of an embodiment of the nonwoven fabric female component wherein one of the steps in the manufacturing method according to the present invention is conducted after the step of FIG. 2.

Now described below are modes of carrying out the method of the present invention in detail. FIGS. 2 and 3 are the drawings which show each of the steps for an embodiment of the method according to the present invention by way of a simplified schematic cross-sectional side view, similarly in FIG. 1. First, as mentioned already, the hydroentangled web (13) is manufactured, with a surface density corresponding to the design (refer to FIG. 2). At that time, the surface density of the hydroentangled web is to be designed in such a manner that the surface density of the final female component product obtained by the step which will be mentioned hereinbelow is to be around 20 to 200 $g/m^2$, or more preferably from 40 $g/m^2$ to 80 $g/m^2$. When the surface density of the female component is made less than the above suitable range, the nonwoven fabric constituting the component becomes non-uniform, and, in addition, the number of the fibers which constitute the loops may become small whereby there are some cases where it is difficult to achieve a good engaging force after repeated use. Further, when the surface density is made more than the above-mentioned suitable range, the thickness of the fiber web may become large prior to the hydroentangling and prior to application of needle punching, and, especially, it may become difficult to process the fiber web to the thickness direction thereof such as in the formation of loops whereby there are some cases where good engaging characteristics are hardly achieved.

The first step, characteristic to the method of the present invention, i.e., a hydroentangling technique for applying hydroentangling to the fiber web (not shown) to form a hydroentangled web (13), is carried out by placing the fiber web on a conveyer net. Thus, for example, a hydroentangled web having a uniform entangled state can be prepared by generating high-pressure water jets of 0.98 to 29.43 MPa (10 to 300 $kgf/cm^2$) using plural nozzles with a nozzle diameter of 0.05 to 0.3 mmϕ on a conveyer net having openings of around 15 to 120 mesh, the nozzles being placed on a nozzle plate in a pitch of about 0.08 to 0.2 mm (pitch in the width direction for production). There is no particular limitation for how many times the hydroentangling process should be applied, but the hydroentangling may be applied at least against one of the superficial sides of the fiber web, or may be applied against one of the superficial sides followed by against another superficial side.

Thereafter, the second step of the method according to the present invention is carried out. The second step includes applying needle punching to the resulting hydroentangled web (13) from one of the superficial sides thereof (an example thereof is shown in FIG. 3 with an arrow "a") whereupon loops (15) are formed. In that case, according to experiments by the present inventors, it may include either a method for applying needle punching to the hydroentangled surface side or a method for applying needle punching to a surface side different from the hydroentangled surface side. There is no particular limitation for the needle used for conducting the present invention, but it is preferred to use crown barb needles in which the cross section of the blade thereof is triangular or nearly square, etc., and plural (e.g., from around 3 to 4) barbs are placed at the positions which are in the same distance from the top end of the blade. When such a needle is used, it is possible to form bunchily loops projecting in nearly the same height on the superficial side different from the side of the fiber web into which the needle enters, thereby efficiently forming a female element having a high engaging capability.

Further, in another preferred mode of carrying out the method of the present invention, a third step may be added after the formation of the above-mentioned loops, the third step including the heat fusing of the needle punched superficial side of the fiber web (the superficial side is a side where needles entered and no loop is formed) to form a flat and smooth region (17) (see FIG. 1) on the web. This step may be conducted, for example, in such a manner that one of a pair of rolls encountering with a certain slit (gap) is heated nearly at the melting point of the constituting fiber (preferably, the low-melting component of the above-mentioned heat-fusible fiber) of the above web when the above web is passed between the rolls, followed by bringing the web surface having no formed loops into contact with the roll. The third step may be conducted in such a manner that the fiber web is previously heated with a high temperature hot air, infrared ray, etc. and the surface having no formed loops is contacted to the roll or drum.

Described below are examples of the present invention which are provided only for illustrative purposes, and not to limit the scope of the present invention. It is to be understood that the present invention is not limited to those examples but may include numerous other embodiments.

Examples disclose the touch and close fasteners to which the techniques according to the present invention are applied and the evaluation results thereof. In the following disclosure, specific conditions are provided for making it easier to understand the present invention, but it should be also noted that the art of the present invention is not limited to such examples only.

Female components concerning Examples 1 to 7 are made up of commercially available heat-fusible fibers (size: 3 deniers; fiber length: 64 mm; and core/sheath-type PP/PE composite fiber) exclusively wherein the fibers are carded and standardized to about 76 g/m$^2$ with regard to the surface density thereof to form a fiber web in which the weight ratio W of a cross-lay web was 100%. This fiber web was treated with high-pressure water jets under various conditions to form a hydroentangled web, dried under heating to such an extent that no thermal influence was resulted on the constituting fiber, and subjected to needle punching using the above-mentioned crown needles under a standardized condition (needle depth: 10 mm and needle density: 50 needles/cm$^2$). After that, each of the webs was subjected to the above-mentioned third step wherein a pair of encountering rolls was used under the temperature condition of 140° C. to manufacture a female component. The resultant female components are used as embodiments of Working Examples. For Comparative Example 1, no hydroentangling was conducted while the second step for forming loops and the third step for forming flat and smooth regions were conducted under the same conditions as in the Examples, thereby manufacturing a sample where the weight ratio W as above-mentioned was 100%. Further, for Comparative Example 2, a commercially available female component made up of knitted or woven fabric ("Take Care", trade name, Sumitomo 3M, Japan; manufactured by bonding a film (surface density: about 29 g/m$^2$; thickness: about 0.15 mm) to a base cloth containing loops (surface density: about 76 g/m$^2$; thickness: about 0.64 mm)) was used as a sample for evaluation.

Furthermore, Example 8 and 9 samples for evaluation were manufactured in the same manner as the above-mentioned samples, except that as a result of preparing a crisscross web containing a unidirectional web the weight ratios (W) of the cross-lay web were 60% and 30%, respectively, and that the surface density was different. Table 1 shows the feature each of those eleven kinds of samples for evaluation and also shows the manufacturing conditions and the final surface density and thickness each for the samples where nonwoven fabric was used.

Remarks: In the column of "Side Where Needle Entered" in this table, the term "Head" means that the firstly hydroentangled side of the fiber web was identical with the needle-entered one in each of the Example samples, while the term "Tail" means that the needle-entered side was different from the hydroentangled one. In other words, when loops were formed on the side identical with the firstly hydroentangled one, it was given as "Tail", while it was given as "Head" when loops were formed on the side different from the firstly hydroentangled one.

TABLE 1

| | Weight Ratio of Crosslay Web:W (%) | Water Jet Entangling Conditions | Side Where Needle Entered | Final Surface Density (g/m$^2$) | Thickness (mm) |
|---|---|---|---|---|---|
| Examples | | | | | |
| 1 | 100 | 3 MPa one side only | Tail | 52.1 | 1.25 |
| 2 | 100 | 3 MPa one side only | Head | 58.3 | 1.09 |
| 3 | 100 | 5 MPa one side only | Tail | 66.6 | 1.09 |
| 4 | 100 | 5 MPa one side only | Head | 64.0 | 1.02 |
| 5 | 100 | 8 MPa one side only | Tail | 63.6 | 1.05 |
| 6 | 100 | 5 MPa both sides | Tail | 57.8 | 1.15 |
| 7 | 100 | 3 MPa both sides | Tail | 65.0 | 1.16 |
| 8 | 60 | 3 MPa both sides | Tail | 77.3 | 1.04 |
| 9 | 30 | 3 MPa both sides | Tail | 73.4 | 1.44 |

TABLE 1-continued

| | Weight Ratio of Crosslay Web:W (%) | Water Jet Entangling Conditions | Side Where Needle Entered | Final Surface Density (g/m$^2$) | Thick-ness (mm) |
|---|---|---|---|---|---|
| Comparative Examples | | | | | |
| 1 | 100 | — | — | 60.3 | 1.27 |
| 2 | — | — | — | 105.0 | 0.80 |

Described below is a method for evaluating an engaging force. As a means for evaluating the engaging force between a male component and a female component for a touch and close fastener, the measurement in accordance with "Peeling Strength" as stipulated in "Test Method for Touch and Close Fastener" (JIS L3416) was conducted in the present examples. To be more specific, commercially available male component "3M CS200" (trade name; manufactured by Sumitomo 3M, Japan; where mushroom-shaped male elements were located in a density of 900 elements/square inch) and each of the female component samples given in Table 1 were cut in strips of 5 cm length and 2.5 cm width, respectively. Each of those samples was used and one male component was placed on one female component in such a manner that the elements of the female component were encountered with those of the male component face-to-face within a width of 2.5 cm and a length of 3 cm leaving the remaining length of 2 cm in a non-engaging manner by inserting a sheet of paper therebetween. Then an engaging operation was conducted by compressing the set sample for evaluation twice for coming-and-going along the longitudinal direction thereof with an engaging roller having a flat surface allowing us to apply a load of 19.6 N (2 kgf) per cm of the effective width of the touch and close fastener thereto. Thereafter, the touch and close fastener was disengaged at a breaking rate of 30 cm/min. wherein a male or female component end which did not participate in engagement was caught by each of a pair of chucks of a tensile tester. Chronological changes in the tension upon the peeling were recorded on a chart paper and an average of total 12 values (6 maximum points and 6 minimum ones) recorded on this chart paper was calculated. Five measurements were conducted for each of the samples and an average of the five measurements was converted to a value per cm of the width of the sample, which was recorded as the initial engaging force. Engaging force measurements were also conducted by subjecting the sample (its initial engaging force was measured) to the above engaging operation five times and ten times, respectively. The results are given in Table 2. In Table 2, for each engaging force at the fifth operation and the tenth operation, the ratio of the fifth engaging force and the tenth engaging force to the initial engaging force is given in terms of % in parentheses, respectively.

TABLE 2

Results of Measurement of Engaging Force (N/cm)

| | Initial operation | fifth operation | tenth operation |
|---|---|---|---|
| Examples | | | |
| 1 | 0.245 | 0.216 (88%) | 0.186 (76%) |
| 2 | 0.353 | 0.490 (139%) | 0.284 (81%) |

TABLE 2-continued

Results of Measurement of Engaging Force (N/cm)

| | Initial operation | fifth operation | tenth operation |
|---|---|---|---|
| 3 | 0.235 | 0.196 (83%) | 0.226 (96%) |
| 4 | 0.265 | 0.245 (93%) | 0.216 (81%) |
| 5 | 0.265 | 0.265 (100%) | 0.216 (81%) |
| 6 | 0.167 | 0.157 (94%) | 0.137 (82%) |
| 7 | 0.343 | 0.471 (137%) | 0.349 (100%) |
| 8 | 0.330 | 0.380 (115%) | 0.253 (77%) |
| 9 | 0.359 | 0.375 (104%) | 0.244 (68%) |
| Comparative Examples | | | |
| 1 | 0.265 | 0.196 (74%) | 0.127 (48%) |
| 2 | 0.657 | 0.490 (75%) | 0.373 (57%) |

It will be understood from the result shown in Table 2 and also from the constitution of each of the samples explained in Table 1 that, when Examples 1 to 9 where the present invention was applied were compared with Comparative Example 1, it is possible to improve an engaging force after repeated engagements in view of its reduction as a result of needle punching formation of the loops on or at a hydroentangled web. It will be particularly noted from the result for Examples 4 and 5 as compared with Comparative Example 1 that, although all of their initial engaging forces were substantially identical, the engaging forces achieved in the two Examples were 20 to 30% higher than that of Comparative Example 1 at the fifth operation and about 50% higher than that even at the tenth operation, respectively.

Further, it was noted from the comparison of Example 1 with Example 2 and also from the comparison of them with Example 7 that the relation between the firstly hydroentangled surface and the needle punched surface was not particularly limited when hydroentangling was applied to at least one side of the fiber web (in other words, a satisfactory durability was noted regardless of both cases where the surface to which high-pressure water jets were entered upon hydroentangling is identical with and different from the surface on which the loops were formed). In addition, it is clear that, although the absolute engaging force of the female component composed of only nonwoven fabric is inferior to that of Comparative Example 2 component composed of knitted or woven fabric, an engaging force after repeated engagements in each of Examples 1 to 9 was improved in view of its reduction to an extent of only about 20 to 30% from the initial stage, while Comparative Example 2 component's engaging force thereupon was around 40% of the initial stage in view of its the reduction.

Furthermore, it is understood from the comparison of Examples 1 to 7 with Examples 8 to 9 where the weight ratio of cross-lay web was changed that the effect of improving an engaging force in view of its reduction was lost, depending on where the content of the unidirectional web was increased and the weight ratio (W) of the cross-lay web was reduced to 60% or to 30%.

As mentioned hereinabove, the application of the techniques according to the present invention can solve the problem inherent in a nonwoven fabric female component for a touch and close fastener, with a good productivity, i.e., the problem of reduction in the engaging force upon repeated engagements whereby it is now possible to provide a low-cost female component, with good characteristics, for a touch and close fastener.

What is claimed is:

1. A nonwoven fabric female component for a touch and close fastener in which projecting loops are formed on one of the superficial sides of the nonwoven fabric, wherein (I) said nonwoven fabric comprises a hydroentangled web; and (II) said loops are projectingly formed by needle punching on at least one of the superficial sides of said hydroentangled web, wherein another superficial side of said hydroentangled web has a flat and smooth region formed by a heating treatment of fibers which constitute said hydroentangled web.

2. The female component according to claim 1 in which the weight ratio W (in terms of %) of the cross-lay web is 30–100%.

3. The female component according to claim 1 in which said hydroentangled web is mainly composed of heat-fusible fibers.

4. An article of clothing including the nonwoven fabric female component of claim 1.

5. A method for the manufacture of a nonwoven fabric female component for a touch and close fastener in which loops are projectingly formed on one of the superficial sides of the nonwoven fabric, said method comprising the steps of:

(I) forming a hydroentangled web;

(II) needle punching said hydroentangled web to form the loops; and (III) heat-fusing said needle punched superficial side to form a flat and smooth region.

* * * * *